United States Patent [19]

Davis

[11] 4,282,676

[45] Aug. 11, 1981

[54] MECHANICAL SOUND MECHANISM

[75] Inventor: Robert E. Davis, North Branford, Conn.

[73] Assignee: Ideal Toy Corporation, Hollis, N.Y.

[21] Appl. No.: 79,842

[22] Filed: Sep. 28, 1979

[51] Int. Cl.[3] ..... A63H 5/00; G11B 3/00

[52] U.S. Cl. ..... 46/118; 46/175 AR; 369/67

[58] Field of Search ..... 46/118, 117, 175 AR, 46/232, 111, 112, 99, 98; 274/1 A, 9 R, 26, 16

[56] References Cited

U.S. PATENT DOCUMENTS

| | | | |
|---|---|---|---|
| 1,837,076 | 12/1931 | Shulman | 46/175 AR |
| 2,265,318 | 12/1941 | Sempre | 274/9 R |
| 2,978,836 | 4/1961 | Kato | 46/118 X |
| 3,017,187 | 1/1962 | Ryan | 46/118 X |
| 3,055,664 | 9/1962 | Curci | 274/9 R X |
| 3,234,687 | 2/1966 | Elwell | 46/141 X |
| 3,384,378 | 5/1968 | Allen | 274/1 A |
| 3,538,638 | 11/1970 | Glass et al. | 46/135 R X |
| 3,572,704 | 3/1971 | Glass et al. | 46/232 X |
| 3,753,568 | 8/1973 | Buck et al. | 274/1 A X |
| 4,231,184 | 11/1980 | Corris et al. | 46/118 X |

FOREIGN PATENT DOCUMENTS 2234609 9/1973 Fed. Rep. of Germany ..... 46/175 AR

*Primary Examiner*—Gene Mancene
*Assistant Examiner*—Mickey Yu
*Attorney, Agent, or Firm*—Richard M. Rabkin

[57] ABSTRACT

A toy doll includes a sound reproducing device having a rotatable grooved record and a transmission for rotating the record in a predetermined direction upon oscillation of the doll's arm. A tone arm bearing a needle is supported in the doll's body for engagement with the record and has one end thereof engaged against a sound reproducing diaphragm. The diaphragm is mounted for movement towards and away from the record in response to selective positioning of the doll's arm and is operatively engaged with the tone arm to draw the tone arm away from the record when the diaphragm moves away from the record, while permitting the tone arm to move along the surface of the record as the needle tracks in the grooves thereof. A spring arrangement normally holds the tone arm engaged with the record, and applies a biasing force biasing the record towards the start position. When the doll's arm is moved to the appropriate position, the diaphragm and tone arm are moved away from the record and the spring arrangement returns the tone arm to its start position.

7 Claims, 4 Drawing Figures

MECHANICAL SOUND MECHANISM

The present invention relates to toy dolls, and in particular to a sound reproducing toy doll having an improved sound reproducing mechanism.

Toy dolls having the ability to create sound have been previously proposed in a variety of different constructions. In particular, many dolls have been proposed in which a grooved record is mounted within the doll's body and engaged with a needle carrying tone arm and diaphragm structure in order to reproduce the sounds impressed on the record. Such dolls are shown for example in U.S. Pat. Nos. 303,488 to Wilhelm; 1,912,291 to McDermott; 3,208,755 to Lieberman; and 1,837,076 to Shulman. In each case a mechanism is provided which allows the needle carrying tone arm to be separated from the record and returned to a start position at the beginning of the record adjacent the outer peripheral edge thereof. The Shulman reference is of particular interest with respect to the present invention in that the mechanism disclosed therein is controlled and operated by movement of the doll's arm. However, each of these mechanisms is relatively complicated in construction, particularly the Shulman device, and thus are relatively expensive to manufacture and may not be reliable in use.

It is an object of the present invention to provide a simplified and improved sound reproducing device for use in a toy doll.

Another object of the present invention is to provide a sound reproducing device which is adapted to be operated upon movement of a doll's arm.

A further object of the present invention is to provide an improved sound reproducing device wherein the tone arm is automatically disengaged from the record and returned to its start position along a path which is spaced from the surface of the record.

A still further object of the present invention is to provide a sound reproducing device for use in a toy doll which is relatively simple and inexpensive in construction.

Another object of the present invention is to provide an improved sound reproducing device for use in a toy doll which is reliable and durable in use.

In accordance with an aspect of the present invention a toy doll is provided which includes a body and at least one arm that is pivotally mounted on the body for movement through a predetermined arc of up to 360°. A sound reproducing device is mounted in the doll's body and includes a rotatable grooved phonograph record. A gear transmission arrangement is operatively connected between the rotatable arm and the record for rotating the record in only a predetermined direction upon oscillation of the doll's arm. A diaphragm support element is movably mounted in the doll's body for movement between a first position adjacent the record and a second position spaced from the record.

A tone arm having a first end portion engaged with the diaphragm on the diaphragm support element has a needle mounted therein for operative engagement with the record. The tone arm is mounted for swinging movement in a plane generally parallel to the record to allow the needle to track in the record groove. The mounting for the tone arm also permits movement of the needle end towards and away from the record with the diaphragm, upon movement of the diaphragm support. A carrying element is provided on the diaphragm support engaged with the tone arm for carrying the tone arm with the diaphragm support between the diaphragm support positions, while permitting the tone arm to swing during tracking on the record. This carrier element also defines the start position for the tone arm adjacent the outer peripheral edge of the record. A spring arrangement is provided which normally biases the diaphragm support into its first position adjacent the record so that the needle engages the record and the diaphragm is held in engagement with the tone arm thereby to produce sound upon vibration of the needle during rotation of the record. The spring arrangement also normally biases the tone arm towards the start position.

The transmission arrangement which drives the record also includes means for selectively moving the diaphragm support from its first position to its second position upon movement of the arm to a predetermined position in its permitted arcuate movement. When the arm is moved to that position, the diaphragm support element, and thus the tone arm, are raised away from the record and the spring arrangement returns the tone arm to its start position. When the doll's arm is moved away from that predetermined position the diaphragm support is released and returns to its first position under the influence of the spring arrangement. Thereafter, upon oscillation of the doll's arm the record is rotated and the needle tracks in the record against the bias of the spring arrangement.

The above and other objects, features and advantages of this invention will be apparent in the following detailed description of an illustrative embodiment thereof, which is to be read in connection with the accompanying drawings, wherein.

Figure 1:
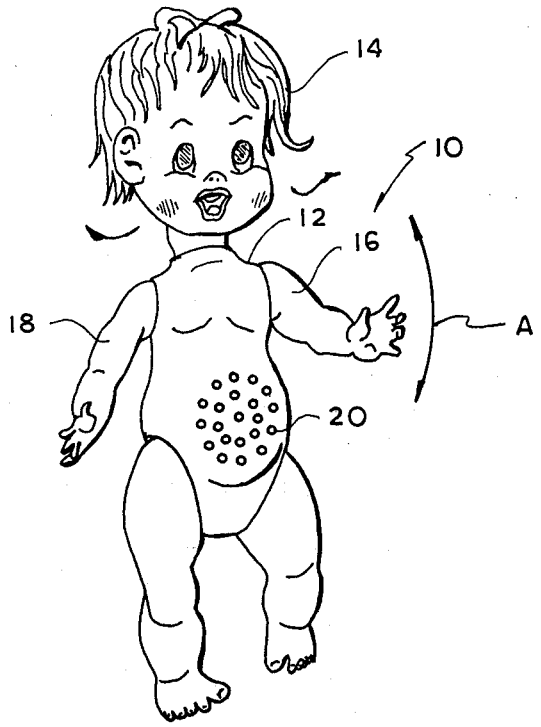
FIG. 1 is a perspective view of a toy doll containing a sound reproducing device in accordance with the present invention.

Referring now to the drawing in detail, and initially to FIG. 1 thereof, a toy doll 10, constructed in accordance with the present invention, includes a body 12, head 14 and arms 16, 18. A sound reproducing device (not shown in FIG. 1) is mounted within the body and is constructed, as described hereinafter, to produce sound upon oscillation of the doll's arm 16 in an arcuate path, represented by the arrow A. Preferably the front of the doll's body includes a series of apertures 20 formed therein to permit the sound produced in the doll to escape. The doll's head, body and arms are of conventional plastic construction.

Figure 2:
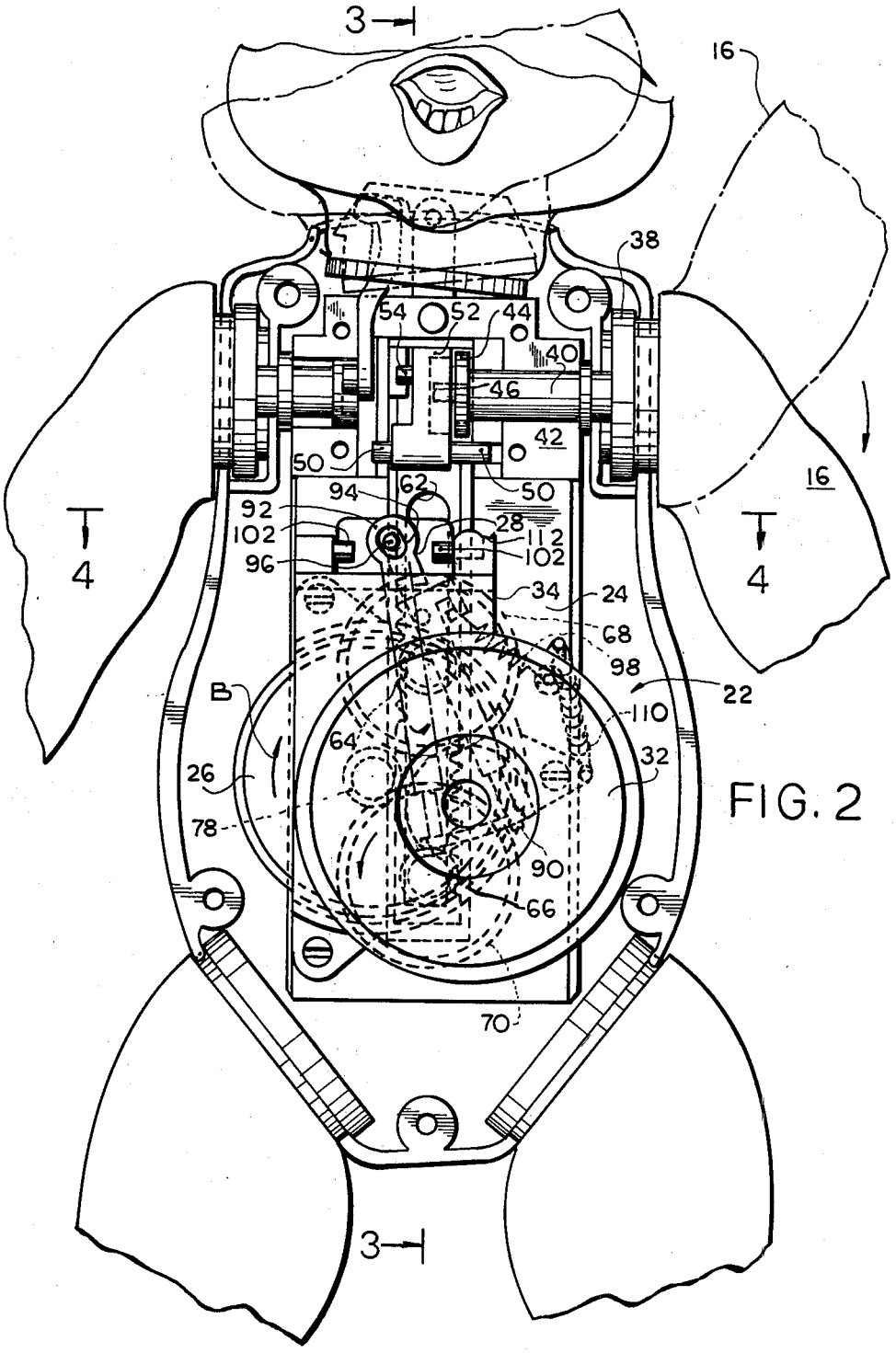
FIG. 2 is an enlarged front view of the toy doll of FIG. 1, with the front of the doll's body removed to expose the sound reproducing device contained therein.
Figure 3:
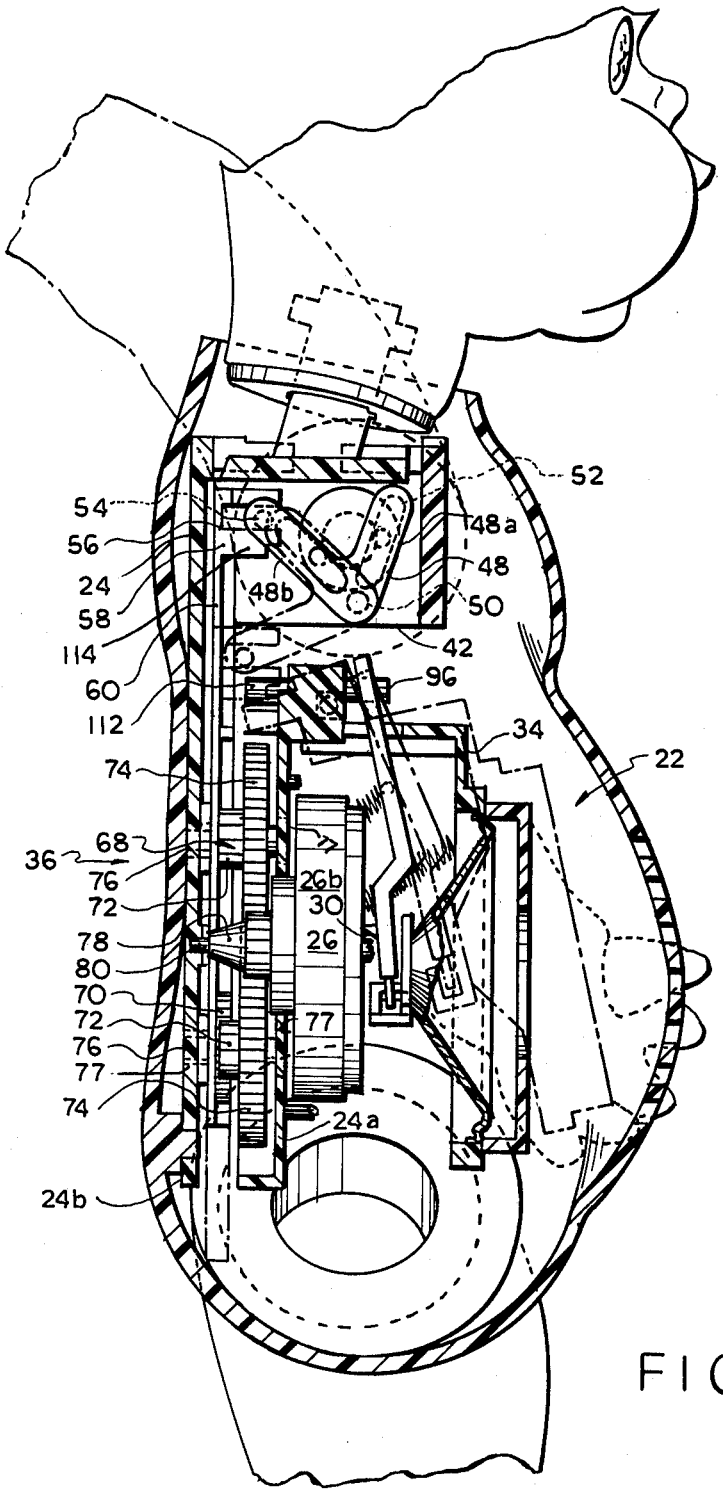
FIG. 3 is a side sectional view taken along line 3—3 of FIG. 2.

Referring now to FIGS. 2 and 3 of the drawing, the sound reproducing device 22 of the present invention is shown in detail. The device includes a support frame 24 mounted in the doll's body in any convenient manner and having a grooved record 26 rotatably mounted thereon. A tone arm 28 is mounted on frame 24 for swinging movement in a plane parallel to the surface of record 26. The tone arm includes a needle 30 which tracks in the record grooves.

A diaphragm 32 is mounted on a diaphragm support element 34 and is engaged with the end of the tone arm adjacent the needle. The diaphragm support element 34 is pivotally mounted on frame 24 for movement towards and away from the record, as illustrated in solid and dotted lines in FIG. 3.

The record is driven through a transmission 36 which is operatively connected between the record and arm 16 of the doll. Upon oscillation of arm 16 record 26 is driven in a predetermined direction, indicated by the arrow B in FIG. 2, regardless of the direction of movement of the arm. As the record rotates the needle tracks in the grooves of the record causing the tone arm to move therewith (as indicated by the dashed and phantom lines in FIG. 2). When the tone arm has tracked to the inner end of the record (or to any position between the beginning of the record and the end of the record) the user may move the doll's arm to a predetermined position, indicated in phantom lines in FIG. 2, with the result that the diaphragm is lifted away from the record, as indicated by the phantom lines in FIG. 3, and the tone arm returned to the start position. Movement of the doll's arm 16 away from the predetermined position will permit the diaphragm and thus the tone arm to return to the solid line position of FIG. 3 wherein the needle is engaged with the grooves of the record.

Arm 16 includes an integral bearing extension 38, rotatably mounted in the shoulder of the doll's body, as illustrated in FIG. 2. A hard plastic insert element 40 is secured in the end of the arm and extends into the interior of the body. This insert element is rotatably mounted in a support block 42 mounted on frame 24 and has an inner end 44 which includes an eccentric drive crank pin 46.

A bell crank lever 48 is pivotally mounted by a pin 50 in support block 42. The bell crank has an elongated recess 52 formed in its leg 48*a*, as illustrated in FIG. 3, on the side thereof facing crank pin 46. The crank pin is received in this slot and oscillation of the arm, which causes oscillation of the eccentric pin, causes the bell crank itself to oscillate about its pivot mounting 50.

The other leg 48*b* of bell crank 48 has a drive pin 54 secured thereto. This pin is received in a drive slot 56 formed in a boss 58 at the upper end of a rack gear 60. The rack gear, as seen in FIG. 2, is a generally rectangular member and has an elongated slot 62 formed therein. The slot has a first set of rack teeth 64 formed along one side thereof and a second set of rack teeth 66 formed along the other side thereof, in longitudinally offset relation to rack teeth 64.

Rack 60 forms part of transmission 36 which also includes a pair of compound gears 68, 70. These gears each include a small spur gear 72 and a larger integrally formed spur gear 74. The gears are mounted for rotation in support frame 24 by their shaft ends 76. These shaft ends are rotatably received in elongated slots 77 formed in the upper and lower panels 24A and 24B of support 24. These slots are located in longitudinal alignment with the path of travel of rack 60.

The larger gears 74 of compound gears 68, 70 are located to be moved into and out of engagement with a spur gear 78 integrally formed with or secured to the bottom of record 26 in order to drive the record. In this regard it is noted that the record preferably is formed with an upper grooved surface 26A formed of plastic or the like and a lower portion 26B formed of a heavy metal, to act as a flywheel for the record. A shaft 80 is secured to the record and extends through opposite sides thereof and is rotatably mounted in frame 24.

Because of the slotted mounting of compound gears 68, 70, record 26 will be driven in the direction of arrow B regardless of the direction of movement of the rack gear. That is, when rack gear 60 moves from the position shown in FIG. 2 downwardly, gear section 64 will rotate gear 68, but at the same time it will apply a force to the gear which will cause the gear to move in its slots towards and into engagement with gear 78. At the same time, gear section 66 will apply a force to gear 70 to move the gear in its slot away from gear 78. Since gears 68, 70 are rotated in opposite directions by the rack, only one of these gears can be engaged with gear 78 at one time. Movement of the rack in the opposite direction, i.e. upwardly as shown in FIG. 2, will cause gear 70 to move upwardly into engagement with gear 78 and will cause gear 64 to move away from gear 78. In this manner continuous rotation of record 26 in the desired direction is maintained during oscillation of arm 16.

Figure 4:
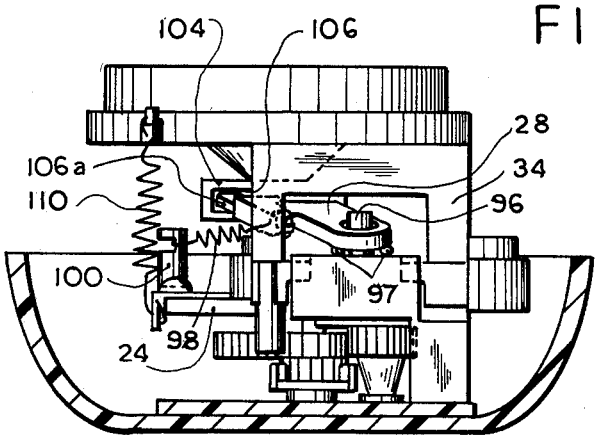
FIG. 4 is a sectional view taken along line 4—4 of FIG. 2.

Tone arm 28 is an enlarged plastic element having the needle 30 mounted at the free end 90 thereof. The opposite end 92 of the tone arm has an aperture 94 formed therein which receives a pin 96 on support frame 24. This mounting arrangement permits the tone arm to swing in a plane generally parallel to the plane of record 26 so that the needle can track in the grooves of the record. In addition, the mounting permits the tone arm to be pivoted upwardly away from the record to disengage the needle therefrom. To permit this upward pivotal movement, and to reduce friction in the device, a pair of integral bearing spheres 97 are formed on the lower surface of end 92 of the tone arm, as seen in FIG. 4.

A spring 98 is engaged between the tone arm and a stud 100 on the frame 24. The connection of the spring to the stud 100 is slightly below the connection of the spring to the tone arm, so that the spring produces a biasing force which biases the tone arm towards the record surface to maintain the needle in engagement with the record. In addition, as seen in FIG. 4, spring 98 applies a biasing force to the tone arm which normally urges the tone arm to its starting position, as defined hereinafter, adjacent the outer periphery of the record. When the needle tracks in the groove of the record the tone arm is pivoted about pin 96 against the bias of spring 98.

The diaphragm support element or frame 34 is pivotally mounted on frame 24 by a pair of pins 102, in any convenient manner. The support 34 extends above record 26 and supports diaphragm 32. The diaphragm may be secured to the support 34 in any convenient manner. The diaphragm is of generally conical shape formed from a plastic material in a conventional and known manner.

A tone arm carrier member 104 is secured to the apex of the diaphragm cone, for example by an adhesive or heat seal or the like, and has an elongated slot 106 formed therein. (See FIG. 4). The slot lies generally parallel to the surface of the record and receives the free end 90 of tone arm 28. This slot permits the tone arm to swing along the record surface while the needle is engaged with the groove. At the same time, the end 106A of the slot, as seen in FIG. 4, acts as a stop limiting swinging movement of the tone arm under the influence of spring 98. This end of the slot is located to align the needle adjacent the peripheral edge of the record in order to locate the needle at the start of the record. In addition, the upper portion of carrier element 104 bears lightly against the tone arm, in order to transmit vibrations from the tone arm to the diaphragm.

A spring 110 is operatively engaged between the diaphragm support and a portion of the frame 24, as seen in FIGS. 2 and 4. This spring normally biases diaphragm support element 34 into the first solid line position thereof illustrated in FIG. 3, wherein the support is adjacent the record and the needle is engaged therewith. The spring also serves to hold the carrier element 104 against the free end of the tone arm. However it is contemplated that spring 110 might be eliminated and that spring 98 may function alone to bias diaphragm support 34 to its first position, because of the engagement of the free end of the tone arm in carrier element 104.

Diaphragm support 34 includes a depending pin 112 located adjacent pivot pins 102. Pin 112 extends from support 34 towards rack 60, as seen in FIG. 4. In this position the pin is in the path of travel of an abutment 114 integrally formed with rack gear 60.

Bell crank 48 is mounted in the doll, and engaged with rack 60, such that when the doll's arm is moved to a predetermined position, illustrated for example in phantom lines in FIG. 3, abutment 114 is moved against pin 112. This will cause frame 34 to pivot in a counterclockwise direction as seen in FIG. 3 and move away from the record. Movement of frame 34 in this manner carries tone arm 28 with the support because of the engagement of the free end 90 of the tone arm in carrier element 104. Once needle 30 is disengaged from the record the tone arm returns to its start position, as defined by the edge 106A of slot 106, under the influence of spring 98.

In operation of the doll the doll's arm 16 will typically be oscillated in only a small arc, causing bell crank 48 to oscillate slightly within the doll and in turn oscillate rate gear 60. This will cause gears 68, 70 to alternately drive gear 78 and thus record 26 in a continuous predetermined direction. The weight of flywheel 26B compensates for any instantaneous discontinuity in the drive of the record and produces a smoothly rotating record. In the preferred embodiment of the invention, the record sound track is a laugh track, to simulate a child's laugh or giggle.

As the record rotates, needle 30 is maintained in engagement with the record under the influence of springs 98, 110 (although primarily spring 98) in the groove track of the record. When the needle reaches the end of the record, continued oscillation of the doll's arm produces no sound. The user then moves the doll's arm to the extreme, predetermined, position shown in phantom lines in FIG. 3. This causes abutment 114 to engage pin 112 and lift diaphragm support frame 34, and thus the tone arm, away from the record as previously described, so that the tone arm returns to its start position under the influence of spring 98. When arm 16 is moved away from the position shown in phantom lines in FIG. 3, abutment 114 moves away from pin 112 so that the diaphragm support is free to return to its solid line position, shown in FIG. 3, wherein needle 30 again engages the starting point on the record.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A toy doll comprising a body including at least one arm pivotally mounted on said body and a sound reproducing device mounted in said body including a rotatable grooved phonograph record, transmission means operatively connected between said record and said arm for rotating said record in a predetermined direction upon oscillation of said arm; a diaphragm support movably mounted in said body for movement between a first position adjacent said record and a second position spaced from said record, a diaphragm mounted on said diaphragm support above said record, a tone arm having a first end portion engaged with said diaphragm and a needle mounted therein for operative engagement with said record; means for mounting said tone arm for swinging movement in a plane generally parallel to the record to allow the needle to track in the grooved record and for movement towards and away from the record with said diaphragm support, said tone arm being located generally between the record and the diaphragm; means carried by said diaphragm support and engaged with said tone arm for moving the tone arm between said first and second positions with said diaphragm support and defining a start position for the tone arm in a predetermined location relative to the record while permitting said swinging movement of the tone arm; spring means for normally biasing said diaphragm support into said first position adjacent the record whereby the needle engages the record to reproduce sound upon rotation thereof and for normally biasing said tone arm towards said start position; said transmission means including means for selectively moving said diaphragm from said first position to said second position upon movement of said arm to a predetermined position relative to said body whereby the needle is disengaged from the record and returned to its start position; said spring means comprising a first spring for biasing the diaphragm support to its first position and a second spring for biasing the tone arm to said start position and against the record; and said means carried by the diaphragm support comprising a frame element having an elongated slot formed therein positioned above the record and extending along the plane of swinging movement of the tone arm, a portion of said tone arm being engaged in said slot.

2. A toy doll comprising a body including at least one arm pivotally mounted on said body and a sound reproducing device mounted in said body including a rotatable grooved phonograph record, transmission means operatively connected between said record and said arm for rotating said record in a predetermined direction upon oscillation of said arm; a diaphragm support movably mounted in said body for movement between a first position adjacent said record and a second position spaced from said record, a diaphragm mounted on said diaphragm support above said record, a tone arm having a first end portion engaged with said diaphragm and a needle mounted therein for operative engagement with said record; means for mounting said tone arm for swinging movement in a plane generally parallel to the record to allow the needle to track in the grooved record and for movement towards and away from the record with said diaphragm support, said tone arm being located generally between the record and the diaphragm; means carried by said diaphragm support and engaged with said tone arm for moving the tone arm between said first and second positions with said diaphragm support defining a start position for the tone arm in a predetermined location relative to the record while permitting said swinging movement of the tone arm; spring means for normally biasing said diaphragm support into said first position adjacent the record whereby the needle engages the record to reproduce sound upon rotation thereof and for normally biasing said tone arm towards said start position; said transmission means including means for selectively moving said diaphragm support from said first position to said second position upon movement of said arm to a predetermined position relative to said body whereby the needle is disengaged from the record and returned to its start position; said means carried by the diaphragm support brackets comprising a frame element having an elongated slot formed therein positioned above the record and extending along the plane of swinging movement of the tone arm, a portion of said tone arm being engaged in said slot.

3. A sound reproducing device as defined in either of claims 2 or 1 wherein said frame element is secured to said diaphragm and engages the end of the tone arm adjacent the needle for transmitting vibrations from the needle and tone arm to the diaphragm.

4. A sound reproducing device for use in a toy doll comprising, a support frame, a grooved phonograph record rotatably mounted on said support frame; a diaphragm support pivotally mounted on said support frame for pivotal movement between first and second positions relative to said record in a plane generally perpendicular thereto, a diaphragm mounted on said diaphragm support above the record, a tone arm including a needle at one end thereof, and means for mounting said tone arm for swinging movement in a plane generally parallel to the record with the needle overlying and engaged therewith and for pivotal movement towards and away from the record with said diaphragm support, said tone arm being located generally between the record and the diaphragm; means carried by said diaphragm support and engaged with said tone arm for moving the tone arm between said first and second positions with said diaphragm support and defining a start position for the tone arm in a predetermined location relative to the record while permitting said swinging movment; spring means for normally biasing said diaphragm support into said first position adjacent the record wherein the needle engages the record to reproduce sound upon rotation thereof and for normally biasing said tone arm towards said start position; and means for moving said diaphragm support from said first position to said second position, wherein the needle is disengaged from the record, whereby the spring means returns the tone arm to its starting position; said spring means comprising a first spring for biasing the diaphragm support to its first position and a second spring for biasing the tone arm to said start position and against the record; and said means carried by the diaphragm support comprising a frame element having an elongated slot formed therein positioned above the record and extending along the plane of swinging movement of the tone arm, a portion of said tone arm being engaged in said slot.

5. A sound reproducing device for use in a toy doll comprising, a support frame, a grooved phonograph record rotatably mounted on said support frame; a diaphragm support pivotally mounted on said support frame for pivotal movement between first and second positions relative to said record in a plane generally perpendicular thereto, a diaphragm mounted on said diaphragm support above the record, a tone arm including a needle at one end thereof, and means for mounting said tone arm for swinging movement in a plane generally parallel to the record with the needle overlying and engaged therewith and for pivotal movements towards and away from the record with said diaphragm support, said tone arm being located generally between the record and the diaphragm; means carried by said diaphragm support and engaged with said tone arm for moving the tone arm between said first and second positions with said diaphragm support and defining a start position for the tone arm in a predetermined location relative to the record while permitting said swinging movement; spring means for normally biasing said diaphragm support into said first position adjacent the record wherein the needle engages the record to reproduce sound upon rotation thereof and for normally biasing said tone arm towards said start position; and means for moving said diaphragm support from said first position to said second position, wherein the needle is disengaged from the record, whereby the spring means returns the tone arm to its start position; said means carried by the diaphragm support comprising a frame element having an elongated slot formed therein positioned above the record and extending along the plane of swinging movement of the tone arm, a portion of said tone arm being engaged in said slot.

6. A sound reproducing device as defined in either of claims 5 or 4 wherein said frame element is secured to said diaphragm and engages the end of the tone arm adjacent the needle for transmitting vibrations from the needle and tone arm to the diaphragm.

7. A sound reproducing device for use in a toy doll comprising, a support frame, a grooved phonograph record rotatably mounted on said support frame; a diaphragm support pivotally mounted on said support frame for pivotal movement between first and second positions relative to said record in a plane generally perpendicular thereto, a diaphragm mounted on said diaphragm support above the record, a separate tone arm including a needle at one end thereof, and means for mounting said tone arm for swinging movement relative to said diaphragm support in a plane generally parallel to the record with the needle overlying and engaged therewith and for pivotal movement towards and away from the record with said diaphragm support, said tone arm being located generally between the record and the diaphragm; means carried by said diaphragm support and engaged with said tone arm for moving the tone arm between first and second positions with said diaphragm support and defining a start position for the tone arm in a predetermined location relative to the record while permitting said swinging movement of the tone arm relative to the diaphragm support and the record; spring means for normally biasing said diaphragm support into said first position adjacent the record wherein the needle engages the record to reproduce sound upon rotation thereof and for normally biasing said tone arm towards said start position; and means for moving said diaphragm support from said first position to said second position, wherein the needle is disengaged from the record, whereby the spring means returns the tone arm to its start position; said spring means comprising a first spring for biasing the diaphragm support to its first position and a second spring for biasing the tone arm to said start position and against the record; said tone arm having an aperture formed in one end thereof and said means for mounting the tone arm comprising a post on said frame received in said aperture; said first spring means being positioned between said frame and said tone arm to hold the tone arm on said post.

* * * * *